US007988424B2

(12) United States Patent
Slepski et al.

(10) Patent No.: US 7,988,424 B2
(45) Date of Patent: Aug. 2, 2011

(54) BUCKET FOR THE LAST STAGE OF A STEAM TURBINE

(75) Inventors: Jonathon E. Slepski, Clifton, NY (US); Andrey A. Chernobrovkin, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 384 days.

(21) Appl. No.: 12/410,856

(22) Filed: Mar. 25, 2009

(65) Prior Publication Data

US 2010/0247318 A1 Sep. 30, 2010

(51) Int. Cl.
*F01D 5/14* (2006.01)

(52) U.S. Cl. ..... 416/243; 416/DIG. 2

(58) Field of Classification Search ..... 416/223 R, 416/242, 243, DIG. 2
See application file for complete search history.

(56) References Cited

U.S. PATENT DOCUMENTS

| | | | |
|---|---|---|---|
| 4,900,230 | A | 2/1990 | Patel |
| 5,160,242 | A | 11/1992 | Brown |
| 5,267,834 | A | 12/1993 | Dinh et al. |
| 5,277,549 | A | 1/1994 | Chen et al. |
| 5,286,169 | A | 2/1994 | Dinh et al. |
| 5,299,915 | A | 4/1994 | Dinh et al. |
| 5,393,200 | A | 2/1995 | Dinh et al. |
| 5,445,498 | A | 8/1995 | Williams et al. |
| 5,480,285 | A | 1/1996 | Patel et al. |
| 5,509,784 | A | 4/1996 | Caruso et al. |
| 6,450,770 | B1 | 9/2002 | Wang et al. |
| 6,461,110 | B1 | 10/2002 | By et al. |
| 6,474,948 | B1 | 11/2002 | Pirolla et al. |
| 6,503,059 | B1 | 1/2003 | Frost et al. |
| 6,558,122 | B1 | 5/2003 | Xu et al. |
| 6,575,700 | B2 | 6/2003 | Arai et al. |
| 6,579,066 | B1 | 6/2003 | Saito et al. |
| 6,739,839 | B1 | 5/2004 | Brown et al. |
| 6,846,160 | B2 | 1/2005 | Saito et al. |
| 6,881,038 | B1 | 4/2005 | Beddard et al. |
| 6,910,868 | B2 | 6/2005 | Hyde et al. |
| 7,094,034 | B2 | 8/2006 | Fukuda et al. |
| 7,186,090 | B2 | 3/2007 | Tomberg et al. |
| 7,384,243 | B2 | 6/2008 | Noshi |
| 2008/0101959 | A1 | 5/2008 | McRae et al. |

*Primary Examiner* — Nathaniel Wiehe
(74) *Attorney, Agent, or Firm* — James W. Pemrick; Ernest G. Cusick; Frank A. Landgraff

(57) ABSTRACT

A turbine bucket including a bucket airfoil having an airfoil shape is provided. The airfoil shape has a nominal profile according to the tables set forth in the specification. The X and Y coordinate are smoothly joined by an arc of radius R defining airfoil profile sections at each distance Z. The profile sections at the Z distances are joined smoothly with one another to form a complete airfoil shape.

20 Claims, 3 Drawing Sheets

BUCKET FOR THE LAST STAGE OF A STEAM TURBINE

BACKGROUND OF THE INVENTION

The present invention relates to turbines, particularly steam turbines, and more particularly relates to last-stage steam turbine buckets having improved aerodynamic, thermodynamic and mechanical properties.

Last-stage buckets for turbines have for some time been the subject of substantial developmental work. It is highly desirable to optimize the performance of these last-stage buckets to reduce aerodynamic losses and to improve the thermodynamic performance of the turbine. Last-stage buckets are exposed to a wide range of flows, loads and strong dynamic forces. Factors that affect the final bucket profile design include the active length of the bucket, the pitch diameter and the high operating speed in both supersonic and subsonic flow regions. Damping and bucket fatigue are factors which must also be considered in the mechanical design of the bucket and its profile. These mechanical and dynamic response properties of the buckets, as well as others, such as aero-thermodynamic properties or material selection, all influence the optimum bucket profile. The last-stage steam turbine buckets require, therefore, a precisely defined bucket profile for optimal performance with minimal losses over a wide operating range.

Adjacent rotor buckets are typically connected together by some form of cover bands or shroud bands around the periphery to confine the working fluid within a well-defined path and to increase the rigidity of the buckets. Grouped buckets, however, can be stimulated by a number of stimuli known to exist in the working fluid to vibrate at the natural frequencies of the bucket-cover assembly. If the vibration is sufficiently large, fatigue damage to the bucket material can occur and lead to crack initiation and eventual failure of the bucket components. Also, last-stage buckets operate in a wet steam environment and are subject to potential erosion by water droplets. A method of erosion protection sometimes used, is to either weld or braze a protective shield to the leading edge of each bucket at its upper active length. These shields, however, may be subject to stress corrosion cracking or departure from the buckets due to deterioration of the bonding material as in the case of a brazed shield.

BRIEF DESCRIPTION OF THE INVENTION

In one aspect of the present invention, a turbine bucket including a bucket airfoil having an airfoil shape is provided. The airfoil has a nominal profile substantially in accordance with Cartesian coordinate values of X, Y and Z and arc coordinate R as set forth in Tables 1-19. The X, Y, Z and R distances are in inches, and an arc of radius R smoothly joins the X and Y coordinate values. The airfoil profile sections are defined at each distance Z. The profile sections at the Z distances are joined smoothly with one another to form a complete airfoil shape.

In another aspect of the present invention, a turbine wheel having a plurality of buckets is provided. The buckets include an airfoil having an airfoil shape defined by a nominal profile substantially in accordance with Cartesian coordinate values of X, Y and Z and arc coordinate R as set forth in Tables 1-19. The X, Y, Z and R distances are in inches, and an arc of radius R smoothly joins the X and Y coordinate values. The airfoil profile sections are defined at each distance Z. The profile sections at the Z distances are joined smoothly with one another to form a complete airfoil shape.

In yet another aspect of the present invention, a turbine including a turbine wheel having a plurality of buckets is provided. The buckets include an airfoil having an airfoil shape defined by a nominal profile substantially in accordance with Cartesian coordinate values of X, Y and Z and arc coordinate R as set forth in Tables 1-19. The X, Y, Z and R distances are in inches, and an arc of radius R smoothly joins the X and Y coordinate values. The airfoil profile sections are defined at each distance Z. The profile sections at the Z distances are joined smoothly with one another to form a complete airfoil shape.

DETAILED DESCRIPTION OF THE INVENTION

Figure 1:
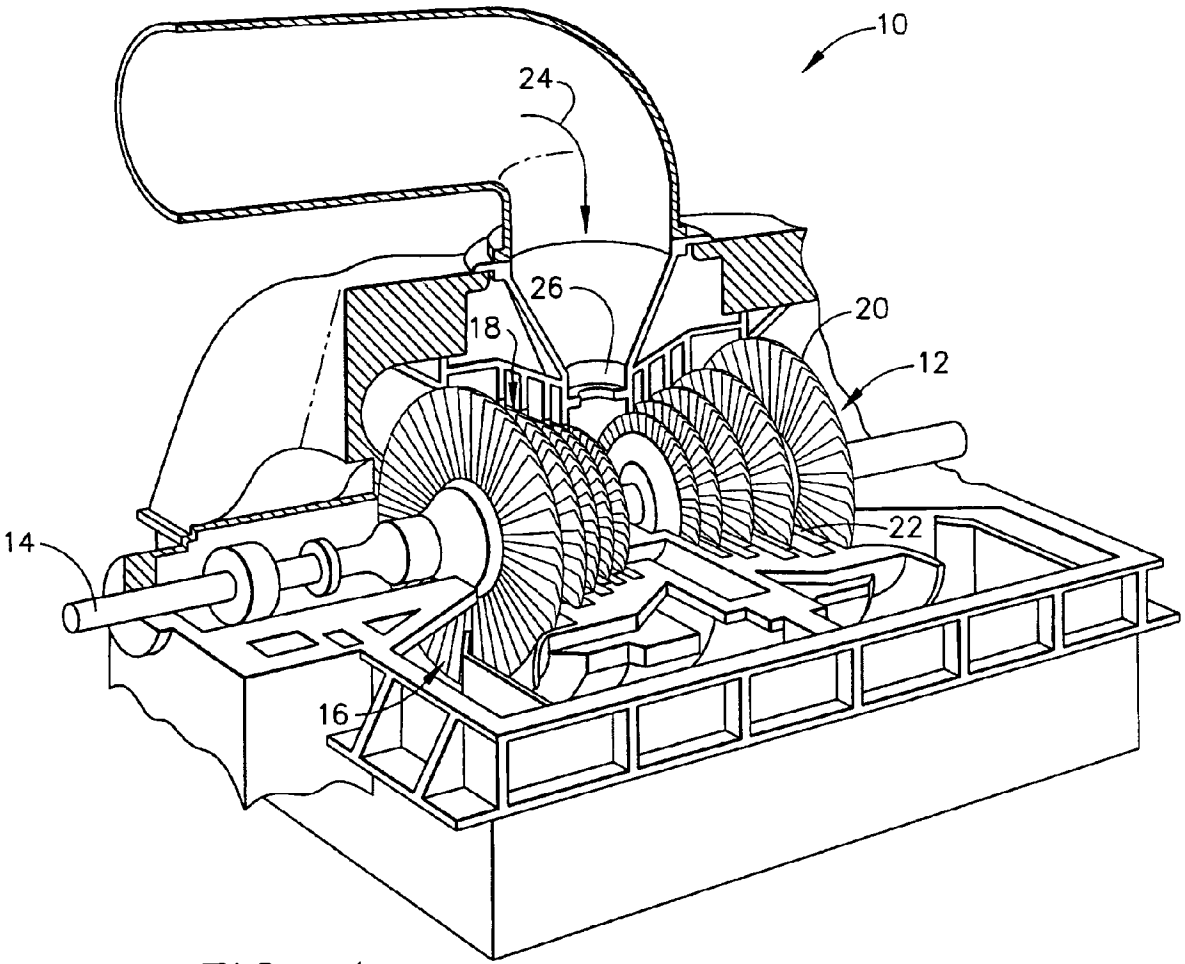
FIG. 1 is a perspective partial cut away illustration of a steam turbine.

FIG. 1 is a perspective partial cut away view of a steam turbine 10 including a rotor 12 that includes a shaft 14 and a low-pressure (LP) turbine 16. LP turbine 16 includes a plurality of axially spaced rotor wheels 18. A plurality of buckets 20 are mechanically coupled to each rotor wheel 18. More specifically, buckets 20 are arranged in rows that extend circumferentially around each rotor wheel 18. A plurality of stationary nozzles 22 extend circumferentially around shaft 14 and are axially positioned between adjacent rows of buckets 20. Nozzles 22 cooperate with buckets 20 to form a turbine stage and to define a portion of a steam flow path through turbine 10.

In operation, steam 24 enters an inlet 26 of turbine 10 and is channeled through nozzles 22. Nozzles 22 direct steam 24 downstream against buckets 20. Steam 24 passes through the remaining stages imparting a force on buckets 20 causing rotor 12 to rotate. At least one end of turbine 10 may extend axially away from rotor 12 and may be attached to a load or machinery (not shown), such as, but not limited, to, a generator, and/or another turbine. Accordingly, a large steam turbine unit may actually include several turbines that are all coaxially coupled to the same shaft 14. Such a unit may, for example, include a high-pressure turbine coupled to an intermediate-pressure turbine, which is coupled to a low-pressure turbine.

Figure 2:
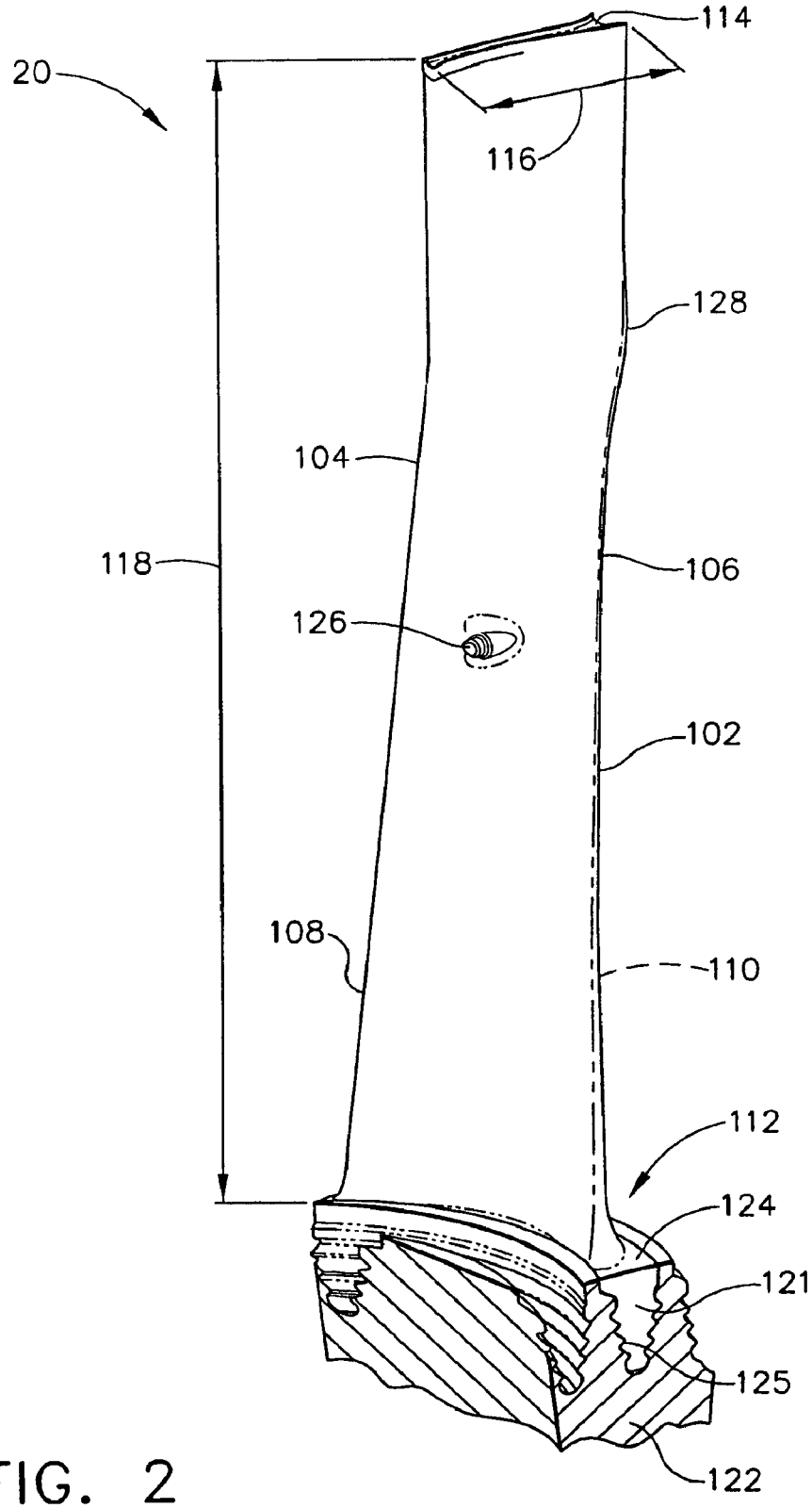
FIG. 2 is a perspective illustration of a turbine bucket that may be used with the steam turbine shown in FIG. 1.

FIG. 2 is a perspective view of a turbine bucket 20 that may be used with turbine 10. Bucket 20 includes a blade portion 102 that includes a trailing edge 104 and a leading edge 106, wherein steam flows generally from leading edge 106 to trailing edge 104. Bucket 20 also includes a first concave sidewall 108 and a second convex sidewall 110. First sidewall 108 and second sidewall 110 are connected axially at trailing edge 104 and leading edge 106, and extend radially between a rotor blade root 112 and a rotor blade tip 114. A blade chord distance 116 is a distance measured from trailing edge 104 to leading edge 106 at any point along a radial length 118 of blade 102. In the exemplary embodiment, radial length 118 is approximately forty-five inches. Although radial length 118 is described herein as being equal to approximately forty-five inches, it will be understood that radial length 118 may be any suitable length depending on the desired application. Root 112 includes a dovetail 121 used for coupling bucket 20 to a rotor disc 122 along shaft 14, and a blade platform 124 that determines a portion of a flow path through each bucket 20. In the exemplary embodiment, dovetail 121 is a curved axial entry dovetail that engages a mating slot 125 defined in rotor disc 122. However, in other embodiments, dovetail 121 could also be a straight axial entry dovetail, angled-axial entry dovetail, or any other suitable type of dovetail configuration.

In the exemplary embodiment, first and second sidewalls, 108 and 110, each include a mid-blade connection point 126 positioned between blade root 112 and blade tip 114 and used to couple adjacent buckets 20 together. In one embodiment, mid-blade connection point 126 is used to couple adjacent buckets 20 together with tie wires (not shown) to facilitate improving a vibratory response of buckets 20 in a mid region between root 112 and tip 114. The mid-blade connection point can also be referred to as the mid-span or part-span shroud. The part-span shroud can be located at about 45% to about 65% of the radial length 118, as measured from the blade platform 124.

An extension 128 is formed on a portion of blade 102 to alter the vibratory response of blade 102. Extension 128 may be formed on blade 102 after a design of blade 102 has been fabricated, and has undergone production testing. At a particular point along radial length 118, a chord distance 116 defines a shape of blade 102. In one embodiment, extension 128 is formed by adding blade material to blade 102 such that at radial distance 118 where the blade material is added, chord distance 116 is extended past leading edge 106 and/or trailing edge 104 of blade 102 as originally formed. In another embodiment, blade material is removed from blade 102 such that at radial distance 118 where blade material has not been removed, chord distance 116 extends past leading edge 106 and/or trailing edge 104 of blade 102 as modified by removing material. In a further embodiment, extension 128 is formed integrally and material at extension 128 may be removed to tune each bucket as dictated by testing. Extension 128 is formed to coincide with an aerodynamic shape of blade 102 so as to facilitate minimizing a flow disturbance of steam 24 as it passes extension 128.

During design and manufacture of bucket 20, a profile of blade 102 is determined and implemented. A profile is a cross-sectional view of blade 102 taken at radial distance 118. A series of profiles of blade 102 taken at subdivisions of radial distance 118 define a shape of blade 102. The shape of blade 102 is a component of an aerodynamic performance of blade 102. After blade 102 has been manufactured the shape of blade 102 is relatively fixed, in that altering the shape of blade 102 may alter the vibratory response in an undesired way. In some known instances, it may be desirable to alter the vibratory response of blade 102 after blade 102 has been manufactured, such as during a post-manufacturing testing process. In order to maintain a predetermined performance of blade 102, the shape of blade 102 may be modified in such a way, as determined by analysis, such as by computer analysis or by empirical study to add mass to blade 102 that alters the vibratory response of blade 102. The analysis determines an optimum amount of mass needed to achieve a desired alteration of the vibratory response of blade 102. Modifying blade 102 with extension 128 to add mass to blade 102, tends to decrease the natural frequency of blade 102. Modifying blade 102 with extension 128 to remove mass from blade 102, tends to increase the natural frequency of blade 102. Extension 128 may also be crafted to alter an aeromechanical characteristic of blade 102 such that an aerodynamic response of blade 102 to a flow of steam 24 past extension 128 will create a desirable change in the vibratory response of blade 102. Thus, the addition of extension 128 may alter the vibratory response of blade 102 in at least two ways, a change of mass of blade 102 and a modification of the airfoil shape of blade 102. Extension 128 may be designed to utilize both aspects of adding mass and changing airfoil shape to effect a change in the vibratory response of blade 102.

In operation, blade 102 undergoes a testing process to validate design requirements were met during the manufacturing process. One known test indicates a natural frequency of blade 102. Modern design and manufacturing techniques are tending toward buckets 20 that are thinner in profile. A thinner profile tends to lower the overall natural frequencies of blade 102. Lowering the natural frequency of blade 102 into the domain of the vibratory forces present in turbine 10, may cause a resonance condition in any number or in an increased number of system modes that each will be de-tuned. To modify the natural frequency of blade 102, mass may be added to or removed from blade 102. To facilitate limiting lowering the natural frequency of blade 102 into the domain of the vibratory forces present in turbine 10, a minimum amount of mass is added to blade 102. In the exemplary embodiment, extension 128 is machined from a forged material envelope of leading edge 106 of blade 102. In other embodiments, extension 128 may be coupled to blade 102 using other processes. In the exemplary embodiment, extension 128 is coupled to blade 102 between connection point 126 and blade tip 114. In other embodiments, extension 128 may be coupled to leading edge 106 between blade root 112 and blade tip 114, to trailing edge 104 between blade root 112 and blade tip 114, or may be added to sidewalls 108 and/or 110.

The above-described turbine rotor blade extension is cost effective and highly reliable. The turbine rotor blade includes a first and second sidewall coupled to each other at their respective leading edge and trailing edge. An extension coupled to the blade, or removed from the blade forged material envelope alters the blade natural frequency and improves reliability. The amount of material in the extension is facilitated to be minimized by analysis or testing of the rotor blade. Minimizing this mass addition reduces to total weight of the blade, thus minimizing both blade and disk stress and improves reliability. As a result, the turbine rotor blade extension facilitates operating a steam turbine in a cost effective and reliable manner.

Figure 3:
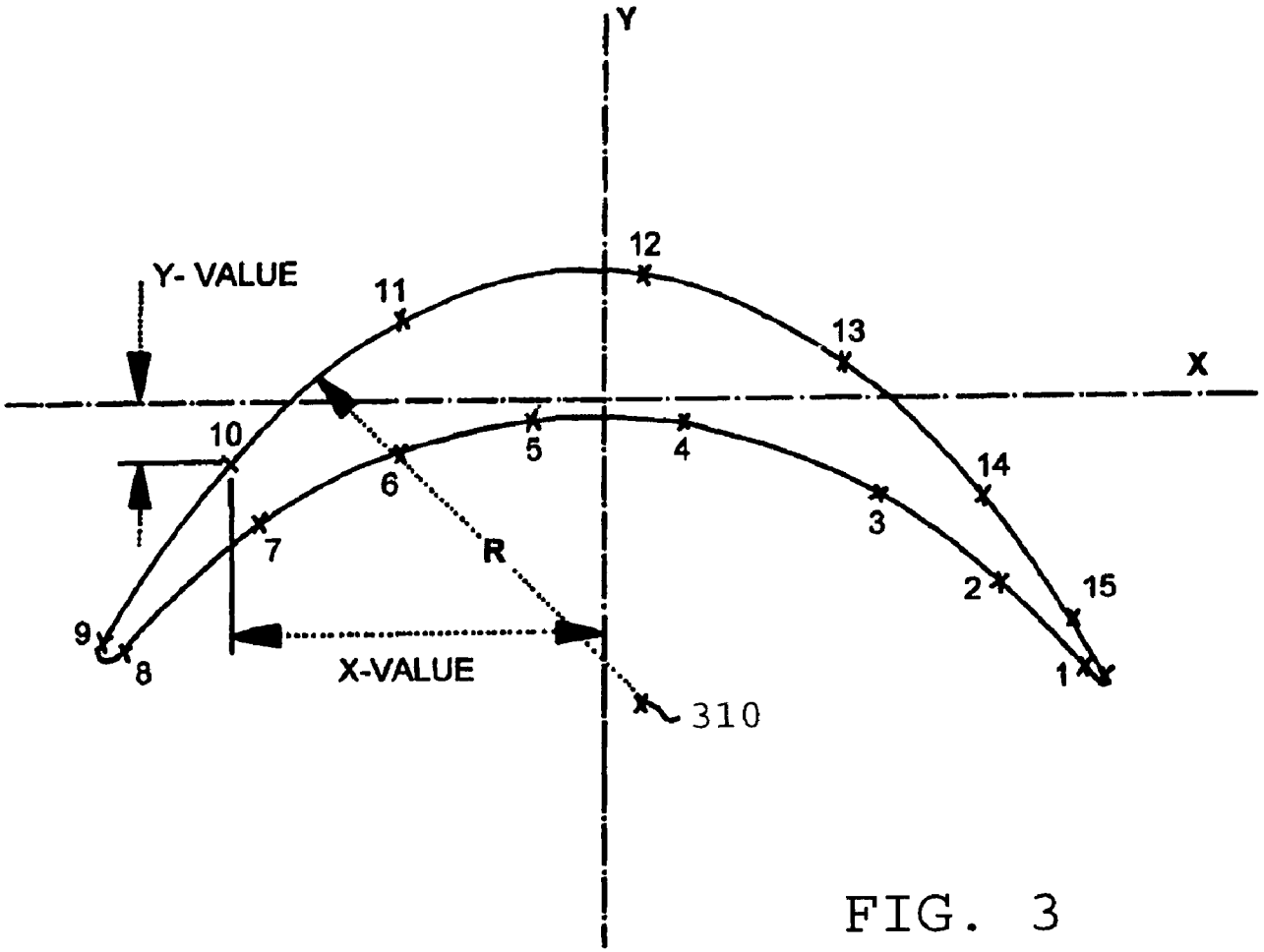
FIG. 3 is a graph illustrating a representative airfoil section of the bucket profile as defined by the tables set forth in the following specification.

Referring now to FIG. 3, there is illustrated a representative bucket section profile at a predetermined distance "Z" (in inches) or radial distance 118 from surface 124. Each profile section at that radial distance is defined in X-Y coordinates by adjacent points identified by representative numerals, for example, the illustrated numerals 1 through 15, and which adjacent points are connected one to the other along the arcs of circles having radii R. Thus, the arc connecting points 10 and 11 constitutes a portion of a circle having a radius R at a center 310 as illustrated. Values of the X-Y coordinates and the radii R for each bucket section profile taken at specific radial locations or heights "Z" from the blade platform 124 are tabulated in the following tables numbered 1 through 19. The tables identify the various points along a profile section at the given heights "Z" from the blade platform 124 by their X-Y coordinates and it will be seen that the tables have anywhere from 13 to 27 representative X-Y coordinate points, depending upon the profile section height from the datum line. These values are given in inches and represent actual bucket configurations at ambient, non-operating conditions (with the exception of the coordinate points noted below for the theoretical blade profiles at the root, mid-point and tip of the bucket). The value for each radius R provides the length of the radius defining the arc of the circle between two of the adjacent points identified by the X-Y coordinates.

The sign convention assigns a positive value to the radius R when the adjacent two points are connected in a clockwise direction and a negative value to the radius R when the two adjacent points are connected in a counterclockwise direction. By providing X-Y coordinates for spaced points about the blade profile at selected radial positions or heights Z from blade platform 124 and defining the radii R of circles connecting adjacent points, the profile of the bucket is defined at each radial position and thus the bucket profile is defined throughout its entire length.

Table 1 represents the theoretical profile of the bucket at the blade platform 124 (i.e., Z=0). The actual profile at that location includes the fillets in the root section connecting the airfoil and dovetail sections, the fillets fairing the profiled bucket into the structural base of the bucket. The actual profile of the bucket at the blade platform 124 is not given but the theoretical profile of the bucket at the blade platform 124 is given in Table 1. Similarly, the profile given in Table 19 is also a theoretical profile, as this section is joined to the tip shroud. The actual profile includes the fillets in the tip section connecting the airfoil and tip-shroud sections. In the middle portion of the blade, a part-span shroud may also be incorporated into the bucket. The tables below do not define the shape of the part-span shroud.

It will be appreciated that having defined the profile of the bucket at various selected heights from the root, properties of the bucket such as the maximum and minimum moments of inertia, the area of the bucket at each section, the twist, torsional stiffness, shear centers and vane width can be ascertained. Accordingly, Tables 2-18 identify the actual profile of a bucket; Tables 1 and 19 identify the theoretical profiles of a bucket at the designated locations therealong.

Also, in one preferred embodiment, the turbine includes 49 buckets, each of the profiles provided by the Tables 2-18 and having the theoretical profile given by the X, Y and R values at the radial distances of Tables 1 and 19. However, it is to be understood that any number of buckets (e.g., more or less than 49) could be employed and the X, Y and R values would be appropriately scaled to obtain the desired bucket profile.

TABLE NO. 1

| Z = 0" | | | |
|---|---|---|---|
| POINT NO. | X | Y | R |
| 1 | 8.14269 | −5.20398 | 0 |
| 2 | 8.05234 | −5.07557 | −16.2182 |
| 3 | 6.88009 | −3.59989 | 0 |
| 4 | 6.79455 | −3.50419 | −12.0433 |
| 5 | 5.46936 | −2.23195 | −10.2247 |
| 6 | 4.00875 | −1.22859 | −11.486 |
| 7 | 2.36161 | −0.46126 | −10.6965 |
| 8 | 0.71906 | 0.00551 | −12.9835 |
| 9 | −0.76065 | 0.21312 | −11.3455 |
| 10 | −2.66242 | 0.20915 | −12.0758 |
| 11 | −4.40123 | −0.06964 | −9.38671 |
| 12 | −6.75505 | −0.9736 | −6.95049 |
| 13 | −8.05266 | −1.89219 | 0.14286 |
| 14 | −8.27779 | −1.72609 | 1.90355 |
| 15 | −8.02488 | −1.32011 | 8.87163 |
| 16 | −6.84361 | −0.12142 | 7.90759 |
| 17 | −5.7334 | 0.65761 | 8.50374 |
| 18 | −3.27442 | 1.61214 | 9.94464 |
| 19 | −0.50286 | 1.81863 | 9.35978 |
| 20 | 2.70352 | 1.02294 | 8.56383 |
| 21 | 4.18539 | 0.1734 | 8.94235 |
| 22 | 6.17556 | −1.78429 | 11.93268 |
| 23 | 6.58317 | −2.37131 | 61.30643 |
| 24 | 7.34792 | −3.57674 | 141.7845 |
| 25 | 7.69087 | −4.13434 | 0 |
| 26 | 8.28597 | −5.11004 | 0.08572 |
| 27 | 8.14269 | −5.20398 | 0 |

TABLE NO. 2

| Z = 4.552" | | | |
|---|---|---|---|
| POINT NO. | X | Y | R |
| 1 | 6.86668 | −5.96371 | −14.0609 |
| 2 | 5.47222 | −3.91188 | −20.4525 |
| 3 | 3.4143 | −1.73999 | −8.60622 |
| 4 | 1.24007 | −0.29415 | −7.37985 |
| 5 | −1.09022 | 0.35078 | −7.68903 |
| 6 | −3.2812 | 0.26831 | −8.90384 |
| 7 | −5.52553 | −0.45946 | −4.54205 |
| 8 | −5.849 | −0.63065 | −10.2262 |
| 9 | −6.25351 | −0.87879 | 0.54072 |
| 10 | −6.39112 | −0.94237 | 0.15144 |
| 11 | −6.58268 | −0.76502 | 0.54072 |
| 12 | −6.52934 | −0.62194 | 4.49951 |
| 13 | −5.1571 | 0.91336 | 6.429 |
| 14 | −2.91267 | 1.91118 | 7.1473 |
| 15 | −0.99193 | 2.08605 | 4.61171 |
| 16 | 0.52219 | 1.75807 | 8.01567 |
| 17 | 2.66566 | 0.4777 | 11.41873 |
| 18 | 4.68621 | −1.71265 | 17.92081 |
| 19 | 5.45598 | −2.90119 | 16.79805 |
| 20 | 5.99933 | −3.89214 | 0 |
| 21 | 7.0082 | −5.88854 | 0.08015 |
| 22 | 6.86668 | −5.96371 | 11.93268 |

TABLE NO. 3

| Z = 9.1028" | | | |
|---|---|---|---|
| POINT NO. | X | Y | R |
| 1 | 5.26358 | −6.07395 | −0.72114 |
| 2 | 5.20983 | −5.9376 | −40.2462 |
| 3 | 4.69365 | −4.97198 | −14.6591 |
| 4 | 2.34221 | −1.80943 | −7.38262 |
| 5 | 0.04359 | −0.21632 | −5.12742 |
| 6 | −1.24096 | 0.15948 | −8.71006 |
| 7 | −2.98287 | 0.25262 | −8.1828 |
| 8 | −3.83361 | 0.16799 | −18.9473 |
| 9 | −5.02122 | −0.05216 | 0.71644 |
| 10 | −5.18645 | −0.06858 | 0.18234 |
| 11 | −5.33788 | 0.21051 | 0.71644 |
| 12 | −5.23152 | 0.34254 | 6.18288 |
| 13 | −3.78337 | 1.39581 | 5.71719 |
| 14 | −2.0806 | 1.97082 | 5.12201 |
| 15 | −0.51004 | 1.99265 | 3.3534 |
| 16 | 0.69203 | 1.57999 | 4.60877 |
| 17 | 1.83358 | 0.65404 | 10.65731 |
| 18 | 3.13974 | −1.15978 | 27.97914 |
| 19 | 3.97105 | −2.72845 | 22.23978 |
| 20 | 4.54028 | −3.98787 | 0 |
| 21 | 5.38821 | −6.03076 | 0.06608 |
| 22 | 5.26358 | −6.07395 | 11.93268 |

TABLE NO. 4

| Z = 11.3776" | | | |
|---|---|---|---|
| POINT NO. | X | Y | R |
| 1 | 4.48709 | −6.06174 | 0 |
| 2 | 4.40741 | −5.89542 | −19.0432 |
| 3 | 4.18165 | −5.43992 | −32.6737 |
| 4 | 3.47323 | −4.13153 | −15.0586 |
| 5 | 2.74312 | −2.9782 | −10.9154 |
| 6 | 1.5228 | −1.52024 | −7.98608 |
| 7 | 0.22255 | −0.46521 | −5.82226 |
| 8 | −0.28202 | −0.17194 | −7.2406 |
| 9 | −1.62911 | 0.36013 | −9.98687 |
| 10 | −3.26816 | 0.67925 | −14.3215 |
| 11 | −4.62007 | 0.7622 | 0.22265 |
| 12 | −4.77165 | 1.14497 | 0.59033 |
| 13 | −4.64949 | 1.23571 | 7.98942 |

TABLE NO. 4-continued

| Z = 11.3776" | | | |
|---|---|---|---|
| POINT NO. | X | Y | R |
| 14 | −3.28705 | 1.83803 | 6.15608 |
| 15 | −2.03335 | 2.11627 | 4.60122 |
| 16 | −0.88106 | 2.10286 | 3.51239 |
| 17 | 0.34231 | 1.69496 | 3.27678 |
| 18 | 0.80173 | 1.38672 | 4.52434 |
| 19 | 1.50883 | 0.67831 | 7.59899 |
| 20 | 2.13789 | −0.24063 | 15.16049 |
| 21 | 2.75458 | −1.41608 | 32.16122 |
| 22 | 3.53705 | −3.22258 | 55.39263 |
| 23 | 3.86564 | −4.06988 | 0 |
| 24 | 4.59621 | −6.01523 | 0.05938 |
| 25 | 4.48709 | −6.06174 | 0 |

TABLE NO. 5

| Z = 13.6522" | | | |
|---|---|---|---|
| POINT NO. | X | Y | R |
| 1 | 3.77201 | −5.97958 | −56.57 |
| 2 | 2.2127 | −3.09834 | −10.9567 |
| 3 | 1.4095 | −1.90098 | −9.75049 |
| 4 | 0.05471 | −0.46967 | −8.82884 |
| 5 | −1.48754 | 0.59729 | −11.1118 |
| 6 | −1.99767 | 0.85836 | −39.815 |
| 7 | −2.98203 | 1.31411 | 0 |
| 8 | −3.55102 | 1.56681 | 73.40256 |
| 9 | −3.87176 | 1.71185 | 16.35228 |
| 10 | −4.02287 | 1.78156 | 0.15137 |
| 11 | −4.03202 | 2.05114 | 3.41315 |
| 12 | −2.79565 | 2.45215 | 4.46469 |
| 13 | −1.31032 | 2.38493 | 3.96666 |
| 14 | 0.02726 | 1.82519 | 4.44377 |
| 15 | 1.14632 | 0.77496 | 5.21119 |
| 16 | 1.57629 | 0.09917 | 11.48497 |
| 17 | 2.08053 | −0.9777 | 42.38902 |
| 18 | 2.56189 | −2.21708 | 79.22593 |
| 19 | 3.13967 | −3.83014 | 0 |
| 20 | 3.86922 | −5.93846 | 0.05291 |
| 21 | 3.77201 | −5.97958 | 32.16122 |

TABLE NO. 6

| Z = 15.9221" | | | |
|---|---|---|---|
| POINT NO. | X | Y | R |
| 1 | 3.20634 | −5.94189 | 0 |
| 2 | 2.3248 | −4.33582 | 16.8259 |
| 3 | 2.04392 | −3.79165 | −16.8259 |
| 4 | 1.38492 | −2.58312 | −14.0679 |
| 5 | 0.29629 | −1.01864 | −12.9619 |
| 6 | −0.94587 | 0.32452 | −22.2454 |
| 7 | −1.84901 | 1.12731 | 22.24539 |
| 8 | −3.00019 | 2.16658 | 8.94741 |
| 9 | −3.13559 | 2.30049 | 13.50015 |
| 10 | −3.29841 | 2.46786 | 0.14302 |
| 11 | −3.24651 | 2.70013 | 2.47322 |
| 12 | −2.1218 | 2.85473 | 3.43836 |
| 13 | −0.83989 | 2.47108 | 3.69043 |
| 14 | 0.03854 | 1.82382 | 5.62144 |
| 15 | 0.87199 | 0.76604 | 6.03234 |
| 16 | 1.22537 | 0.09439 | 13.84047 |
| 17 | 1.65159 | −0.97328 | 12.52819 |
| 18 | 1.72337 | −1.1832 | 107.7916 |
| 19 | 1.92655 | −1.80142 | 0 |
| 20 | 2.67719 | −4.09716 | 37.75222 |
| 21 | 2.73307 | −4.26423 | −37.7522 |
| 22 | 2.81755 | −4.51586 | 0 |
| 23 | 3.28953 | −5.90528 | 0.04563 |
| 24 | 3.20634 | −5.94189 | 0.05938 |

TABLE NO. 7

| Z = 18.2012" | | | |
|---|---|---|---|
| POINT NO. | X | Y | R |
| 1 | 2.72769 | −5.84753 | 0 |
| 2 | 1.96568 | −4.63648 | 3.91954 |
| 3 | 1.87284 | −4.47872 | 0 |
| 4 | 0.60228 | −2.15846 | −64.8003 |
| 5 | −0.28818 | −0.60873 | −16.8873 |
| 6 | −0.77465 | 0.16319 | −35.8688 |
| 7 | −1.53008 | 1.24913 | 35.86876 |
| 8 | −2.0302 | 1.95843 | 6.45422 |
| 9 | −2.58539 | 2.93782 | 0.18456 |
| 10 | −2.43795 | 3.19791 | 2.23922 |
| 11 | −1.3505 | 3.04842 | 3.04942 |
| 12 | −0.29159 | 2.3309 | 2.86304 |
| 13 | 0.09546 | 1.82427 | 6.52936 |
| 14 | 0.52895 | 0.96455 | 6.03718 |
| 15 | 0.68048 | 0.55872 | 71.58372 |
| 16 | 1.13699 | −0.86141 | 6.38032 |
| 17 | 1.16995 | −0.97125 | −6.38032 |
| 18 | 1.1988 | −1.0677 | 0 |
| 19 | 1.50673 | −2.09944 | −84.7491 |
| 20 | 1.98755 | −3.59073 | −19.412 |
| 21 | 2.18539 | −4.15615 | 0 |
| 22 | 2.79457 | −5.81467 | 0.03747 |
| 23 | 2.72769 | −5.84753 | 0.04563 |

TABLE NO. 8

| Z = 20.4775" | | | |
|---|---|---|---|
| POINT NO. | X | Y | R |
| 1 | 2.30728 | −5.82104 | 0 |
| 2 | 1.87407 | −5.11416 | 4.06378 |
| 3 | 1.75979 | −4.91494 | 10.80126 |
| 4 | 1.58846 | −4.58198 | 0 |
| 5 | 0.78939 | −2.93817 | −9.10586 |
| 6 | 0.70437 | −2.76957 | 0 |
| 7 | −0.17713 | −1.02349 | 37.38615 |
| 8 | −1.28734 | 1.34369 | 26.74437 |
| 9 | −2.07022 | 3.40951 | 0.20171 |
| 10 | −1.86439 | 3.67435 | 1.12707 |
| 11 | −1.45991 | 3.56748 | 2.16793 |
| 12 | −0.97706 | 3.25227 | 2.6963 |
| 13 | −0.51512 | 2.73639 | 6.86141 |
| 14 | 0.03467 | 1.77828 | 5.26443 |
| 15 | 0.21824 | 1.33803 | 23.56335 |
| 16 | 0.54362 | 0.38279 | 19.69941 |
| 17 | 0.76215 | −0.35674 | −19.6994 |
| 18 | 0.86791 | −0.72794 | 0 |
| 19 | 1.49937 | −2.9549 | 17.51244 |
| 20 | 1.5854 | −3.25112 | −17.5124 |
| 21 | 1.71651 | −3.69524 | 0 |
| 22 | 2.36646 | −5.79424 | 0.03275 |
| 23 | 2.30728 | −5.82104 | 0.04563 |

TABLE NO. 9

| Z = 22.7558" | | | |
|---|---|---|---|
| POINT NO. | X | Y | R |
| 1 | 2.01086 | −5.78492 | 0 |
| 2 | 1.77127 | −5.39305 | 6.83794 |
| 3 | 1.4921 | −4.89008 | 9.57775 |
| 4 | 1.24813 | −4.36421 | 0 |
| 5 | 1.19473 | −4.23931 | 6.59464 |
| 6 | 1.12336 | −4.06564 | 0 |
| 7 | 0.57085 | −2.66454 | −10.3976 |
| 8 | 0.475 | −2.42989 | 0 |
| 9 | 0.3274 | −2.08079 | −10.244 |
| 10 | 0.27183 | −1.95185 | 0 |
| 11 | −0.31059 | −0.62528 | 59.9572 |

TABLE NO. 9-continued

| Z = 22.7558" | | | |
|---|---|---|---|
| POINT NO. | X | Y | R |
| 12 | −0.67265 | 0.21681 | 22.75803 |
| 13 | −1.20831 | 1.61659 | 11.7057 |
| 14 | −1.57838 | 2.93257 | 6.99237 |
| 15 | −1.71226 | 3.80234 | 0.22265 |
| 16 | −1.37201 | 4.0108 | 1.88442 |
| 17 | −1.01684 | 3.72181 | 2.93469 |
| 18 | −0.59502 | 3.16271 | 5.29042 |
| 19 | −0.26772 | 2.49626 | 9.96354 |
| 20 | 0.03956 | 1.62768 | 33.73321 |
| 21 | 0.35761 | 0.50693 | 0 |
| 22 | 2.0648 | −5.76153 | 0.02969 |
| 23 | 2.01086 | −5.78492 | 0.04563 |

TABLE NO. 10

| Z = 25.0338" | | | |
|---|---|---|---|
| POINT NO. | X | Y | R |
| 1 | 1.81505 | −5.76825 | 15.72298 |
| 2 | 1.56739 | −5.27717 | 30 |
| 3 | 0.65763 | −3.19351 | 75 |
| 4 | −0.44402 | −0.1988 | 26.63003 |
| 5 | −1.04084 | 1.78431 | 13.81459 |
| 6 | −1.43114 | 4.06229 | 0.74728 |
| 7 | −1.43357 | 4.14851 | 0.14272 |
| 8 | −1.20162 | 4.25562 | 0.74728 |
| 9 | −1.12652 | 4.18644 | 2.2833 |
| 10 | −0.72156 | 3.59509 | 12 |
| 11 | 0.07255 | 1.38392 | 0 |
| 12 | 1.86883 | −5.74766 | 0.02901 |
| 13 | 1.81505 | −5.76825 | 11.7057 |

TABLE NO. 11

| Z = 27.3109" | | | |
|---|---|---|---|
| POINT NO. | X | Y | R |
| 1 | 1.66692 | −5.74133 | 0 |
| 2 | 1.12277 | −4.61262 | 4.11497 |
| 3 | 1.03508 | −4.40816 | 23.74997 |
| 4 | 0.84338 | −3.90929 | 0 |
| 5 | 0.63975 | −3.35834 | 0.57106 |
| 6 | 0.63603 | −3.34754 | 5.45871 |
| 7 | 0.62496 | −3.31401 | 0 |
| 8 | −0.24726 | −0.6132 | 32.48476 |
| 9 | −0.86584 | 1.6598 | 18.25371 |
| 10 | −1.1838 | 3.39676 | 21.93099 |
| 11 | −1.23945 | 3.84972 | 24.92753 |
| 12 | −1.28904 | 4.33374 | 0.14286 |
| 13 | −1.03331 | 4.43369 | 2.5686 |
| 14 | −0.68907 | 3.82809 | 12.43525 |
| 15 | −0.2081 | 2.37275 | 36.57981 |
| 16 | −0.03539 | 1.69041 | 134.69 |
| 17 | 0.27682 | 0.37637 | 0 |
| 18 | 1.04382 | −2.94283 | −147.62399 |
| 19 | 1.16922 | −3.46869 | −108.15 |
| 20 | 1.28126 | −3.9302 | 0 |
| 21 | 1.72041 | −5.72213 | 0.02858 |
| 22 | 1.66692 | −5.74133 | 0.02969 |

TABLE NO. 12

| Z = 29.5884" | | | |
|---|---|---|---|
| POINT NO. | X | Y | R |
| 1 | 1.51597 | −5.71912 | 139.3053 |
| 2 | 0.98183 | −4.5066 | 3.01844 |

TABLE NO. 12-continued

| Z = 29.5884" | | | |
|---|---|---|---|
| POINT NO. | X | Y | R |
| 3 | 0.90988 | −4.32532 | 10.77397 |
| 4 | 0.75283 | −3.85543 | 34.20319 |
| 5 | 0.44357 | −2.79355 | 0 |
| 6 | −0.0857 | −0.86034 | 48.60234 |
| 7 | −0.87365 | 2.47549 | 17.30307 |
| 8 | −1.15438 | 4.50507 | 0.44337 |
| 9 | −1.15225 | 4.59529 | 0.08468 |
| 10 | −1.00934 | 4.64551 | 0.44337 |
| 11 | −0.94996 | 4.57459 | 2.57476 |
| 12 | −0.628 | 3.90406 | 29.46461 |
| 13 | −0.00641 | 1.58567 | 70 |
| 14 | 0.1233 | 0.99714 | 0 |
| 15 | 1.56932 | −5.70167 | 0.02823 |
| 16 | 1.51597 | −5.71912 | 134.69 |

TABLE NO. 13

| Z = 31.8659" | | | |
|---|---|---|---|
| POINT NO. | X | Y | R |
| 1 | 1.37725 | −5.69672 | 137.6895 |
| 2 | 0.91796 | −4.60379 | 1.70029 |
| 3 | 0.8722 | −4.48025 | 3.4118 |
| 4 | 0.79678 | −4.21332 | 97.0057 |
| 5 | 0.47157 | −2.80704 | 0 |
| 6 | −0.74575 | 2.64135 | 83.91212 |
| 7 | −0.92003 | 3.4396 | 14.02929 |
| 8 | −1.0334 | 4.03385 | 6.44655 |
| 9 | −1.11124 | 4.71531 | 0.32572 |
| 10 | −1.10944 | 4.77442 | 0.06221 |
| 11 | −1.00462 | 4.81177 | 0.32572 |
| 12 | −0.96456 | 4.76533 | 1.96955 |
| 13 | −0.74312 | 4.35991 | 7.94476 |
| 14 | −0.47464 | 3.57668 | 29.54417 |
| 15 | −0.17891 | 2.45839 | 23.99381 |
| 16 | 0.04576 | 1.44045 | 143.30981 |
| 17 | 0.1273 | 1.02548 | 185.80972 |
| 18 | 0.14862 | 0.91597 | 0 |
| 19 | 1.40035 | −5.52483 | 136.64554 |
| 20 | 1.4305 | −5.68046 | 0.02801 |
| 21 | 1.37725 | −5.69672 | 0.02858 |

TABLE NO. 14

| Z = 34.1435" | | | |
|---|---|---|---|
| POINT NO. | X | Y | R |
| 1 | 1.30024 | −5.68367 | 0 |
| 2 | 0.81215 | −4.56682 | 1.07849 |
| 3 | 0.76343 | −4.43132 | 3.20433 |
| 4 | 0.72698 | −4.29204 | 7.61968 |
| 5 | 0.67477 | −4.05592 | 0 |
| 6 | −0.8365 | 3.33401 | 16.85328 |
| 7 | −0.99746 | 4.24892 | 7.90627 |
| 8 | −1.07009 | 4.9652 | 0.06857 |
| 9 | −0.9417 | 5.00231 | 2.94371 |
| 10 | −0.7577 | 4.60396 | 6.35831 |
| 11 | −0.52553 | 3.84073 | −94.7678 |
| 12 | −0.4565 | 3.55126 | 0 |
| 13 | −0.31732 | 2.97168 | 17.86547 |
| 14 | −0.12419 | 2.06424 | 0 |
| 15 | 0.73398 | −2.55376 | −54.4051 |
| 16 | 0.81808 | −2.99614 | 0 |
| 17 | 1.00508 | −3.95802 | −27.1624 |
| 18 | 1.05339 | −4.20062 | 0 |
| 19 | 1.35238 | −5.66716 | 0.02751 |
| 20 | 1.30024 | −5.68367 | 0.02801 |

TABLE NO. 15

| Z = 36.4218" | | | |
|---|---|---|---|
| POINT NO. | X | Y | R |
| 1 | 1.28721 | −5.67147 | 0 |
| 2 | 0.69127 | −4.42436 | 0.48204 |
| 3 | 0.65442 | −4.31543 | 103.2697 |
| 4 | 0.55332 | −3.8273 | −500 |
| 5 | −0.02683 | −1.03264 | 0 |
| 6 | −0.4485 | 0.96985 | 38.35151 |
| 7 | −0.9102 | 3.62048 | 17.3778 |
| 8 | −1.05546 | 5.1998 | 0.06857 |
| 9 | −0.9233 | 5.22842 | 4.89375 |
| 10 | −0.72457 | 4.6179 | 17.18319 |
| 11 | −0.46267 | 3.40691 | 0 |
| 12 | −0.33716 | 2.70483 | −176.212 |
| 13 | 0.00372 | 0.85533 | 0 |
| 14 | 0.35192 | −0.97896 | −134.032 |
| 15 | 0.98865 | −4.12693 | −55.9761 |
| 16 | 1.31427 | −5.55208 | 0 |
| 17 | 1.33874 | −5.65313 | 0.02751 |
| 18 | 1.28721 | −5.67147 | 0 |

TABLE NO. 16

| Z = 38.7016" | | | |
|---|---|---|---|
| POINT NO. | X | Y | R |
| 1 | 1.25913 | −5.65294 | 87.53835 |
| 2 | 0.72125 | −4.54406 | 1.47705 |
| 3 | 0.66033 | −4.39601 | 5.91333 |
| 4 | 0.47172 | −3.73516 | 82.38358 |
| 5 | −0.04808 | −1.22655 | 10 |
| 6 | −0.08499 | −1.0218 | 0 |
| 7 | −0.51202 | 1.49661 | 48.40389 |
| 8 | −0.82787 | 3.6529 | 23.04195 |
| 9 | −0.97661 | 5.40196 | 0.2199 |
| 10 | −0.97071 | 5.46383 | 0.042 |
| 11 | −0.89751 | 5.48072 | 0.2199 |
| 12 | −0.86487 | 5.42716 | 2.54425 |
| 13 | −0.72316 | 4.99061 | 24.25494 |
| 14 | −0.43944 | 3.53951 | 0 |
| 15 | 0.11067 | 0.18612 | −76.8724 |
| 16 | 0.71254 | −3.04795 | −59.549 |
| 17 | 1.31162 | −5.63353 | 0.02814 |
| 18 | 1.25913 | −5.65294 | 0 |

TABLE NO. 17

| Z = 40.9827" | | | |
|---|---|---|---|
| POINT NO. | X | Y | R |
| 1 | 1.21987 | −5.65479 | 0 |
| 2 | 0.7985 | −4.87148 | 31.42264 |
| 3 | 0.741 | −4.7641 | 1.23199 |
| 4 | 0.65349 | −4.5559 | 5.5107 |
| 5 | 0.61644 | −4.43375 | 16.09645 |
| 6 | 0.39827 | −3.60087 | 38.31746 |
| 7 | 0.08847 | −2.14769 | 0 |
| 8 | −0.0106 | −1.6344 | 25 |
| 9 | −0.21776 | −0.39414 | 0 |
| 10 | −0.55542 | 1.99575 | 57.90813 |
| 11 | −0.81637 | 4.12741 | 28.68988 |
| 12 | −0.93501 | 5.68442 | 0.05714 |
| 13 | −0.83534 | 5.7253 | 0.1515 |
| 14 | −0.80286 | 5.66679 | 6.44268 |
| 15 | −0.65091 | 5.02648 | 0 |
| 16 | −0.54839 | 4.46912 | 18.5916 |
| 17 | −0.44348 | 3.83789 | 0 |
| 18 | 0.2358 | −0.73448 | −9.19071 |
| 19 | 0.2683 | −0.93753 | 0 |
| 20 | 0.35889 | −1.46572 | −33.5814 |
| 21 | 0.47515 | −2.10628 | 0 |

TABLE NO. 17-continued

| Z = 40.9827" | | | |
|---|---|---|---|
| POINT NO. | X | Y | R |
| 22 | 0.52937 | −2.38933 | −43.2909 |
| 23 | 0.98054 | −4.46727 | −60.9649 |
| 24 | 1.11309 | −5.00222 | 0 |
| 25 | 1.27274 | −5.63426 | 0.02858 |
| 26 | 1.21987 | −5.65479 | 0.08572 |

TABLE NO. 18

| Z = 43.2654" | | | |
|---|---|---|---|
| POINT NO. | X | Y | R |
| 1 | 1.18126 | −5.67467 | 0 |
| 2 | 0.84884 | −5.13531 | 2.77432 |
| 3 | 0.49882 | −4.26532 | 70.5369 |
| 4 | −0.07838 | −1.2827 | 38.55754 |
| 5 | −0.23221 | −0.30999 | 63.44528 |
| 6 | −0.40931 | 1.00769 | 0 |
| 7 | −0.59561 | 2.51326 | 59.53784 |
| 8 | −0.79907 | 4.40491 | 30.89333 |
| 9 | −0.90043 | 5.92769 | 0.20122 |
| 10 | −0.89467 | 5.98457 | 0.03843 |
| 11 | −0.82759 | 5.99959 | 0.20122 |
| 12 | −0.79756 | 5.94926 | 1.6985 |
| 13 | −0.69912 | 5.61953 | 34.69339 |
| 14 | −0.41738 | 3.91472 | 0 |
| 15 | 0.16104 | −0.22347 | −44.6866 |
| 16 | 0.57547 | −2.68486 | −60.1787 |
| 17 | 1.04914 | −4.87144 | 0 |
| 18 | 1.23371 | −5.65298 | 0.02876 |
| 19 | 1.18126 | −5.67467 | 0 |

TABLE NO. 19

| Z = 45.55" | | | |
|---|---|---|---|
| POINT NO. | X | Y | R |
| 1 | 1.12747 | −5.71414 | 0 |
| 2 | 0.57999 | −4.88189 | 0.38633 |
| 3 | 0.54175 | −4.80717 | 0.60926 |
| 4 | 0.5103 | −4.69162 | 0 |
| 5 | 0.28237 | −3.34203 | 58.05177 |
| 6 | 0.23511 | −3.05787 | 0 |
| 7 | −0.05661 | −1.27676 | 45.25879 |
| 8 | −0.08987 | −1.07069 | 0 |
| 9 | −0.33632 | 0.47871 | 10 |
| 10 | −0.3961 | 0.91688 | 0 |
| 11 | −0.61081 | 2.80034 | 71.57434 |
| 12 | −0.79431 | 4.61535 | 33.18385 |
| 13 | −0.89791 | 6.24806 | 0.05714 |
| 14 | −0.78605 | 6.26656 | 6.16388 |
| 15 | −0.64595 | 5.69765 | 17.56455 |
| 16 | −0.56598 | 5.26131 | 4.03085 |
| 17 | −0.54606 | 5.13154 | 0 |
| 18 | 0.26807 | −0.8145 | −7.68995 |
| 19 | 0.29713 | −1.00833 | 0 |
| 20 | 0.40029 | −1.6413 | −23.6684 |
| 21 | 0.45034 | −1.93659 | 0 |
| 22 | 0.55916 | −2.55494 | −25.0416 |
| 23 | 0.61114 | −2.84055 | 0 |
| 24 | 0.74545 | −3.55509 | −15.7037 |
| 25 | 0.7916 | −3.79061 | 0 |
| 26 | 1.17933 | −5.69274 | 0.02858 |
| 27 | 1.12747 | −5.71414 | 0 |

Exemplary embodiments of turbine rotor buckets are described above in detail. The turbine rotor buckets are not limited to the specific embodiments described herein, but rather, components of the turbine rotor bucket may be utilized independently and separately from other components described herein. Each turbine rotor bucket component can also be used in combination with other turbine rotor bucket components.

While the invention has been described in terms of various specific embodiments, those skilled in the art will recognize that the invention can be practiced with modification within the spirit and scope of the claims.

What is claimed is:

1. A turbine bucket including a bucket airfoil having an airfoil shape, said airfoil comprising a nominal profile substantially in accordance with Cartesian coordinate values of X, Y and Z and arc coordinate R set forth in Tables 1-19 wherein the X, Y, Z and R distances are in inches, the X and Y coordinate values being smoothly joined by an arc of radius R defining airfoil profile sections at each distance Z, the profile sections at the Z distances being joined smoothly with one another to form a complete airfoil shape.

2. The turbine bucket according to claim 1 forming part of a last stage bucket of a turbine.

3. The turbine bucket according to claim 1, wherein said airfoil shape lies in an envelope within about +/−0.25 inches in a direction normal to any airfoil surface location.

4. The turbine bucket according to claim 1, wherein the height of the airfoil is about 45 inches.

5. The turbine bucket according to claim 1, wherein a part-span shroud is superimposed on the nominal profile of the airfoil.

6. The turbine bucket according to claim 1, wherein the nominal profile for the airfoil applies in a cold, non-operating condition.

7. The turbine bucket according to claim 1, wherein the nominal profile for the airfoil comprises an uncoated nominal profile.

8. A turbine wheel comprising a plurality of buckets, each of said buckets including an airfoil having an airfoil shape, said airfoil comprising a nominal profile substantially in accordance with Cartesian coordinate values of X, Y and Z and arc coordinate R set forth in Tables 1-19 wherein the X, Y, Z and R distances are in inches, the X and Y coordinate values being smoothly joined by an arc of radius R defining airfoil profile sections at each distance Z, the profile sections at the Z distances being joined smoothly with one another to form a complete airfoil shape.

9. The turbine wheel according to claim 8, wherein said airfoil shape lies in an envelope within about +/−0.25 inches in a direction normal to any airfoil surface location.

10. The turbine wheel according to claim 8, wherein the nominal profile for the airfoil applies in a cold, non-operating condition.

11. The turbine wheel according to claim 8, wherein the nominal profile for the airfoil comprises an uncoated nominal profile.

12. The turbine wheel according to claim 8, wherein the turbine wheel comprises a last stage of the turbine.

13. The turbine wheel according to claim 8, wherein the turbine wheel has about 49 buckets.

14. A turbine comprising a turbine wheel having a plurality of buckets, each of said buckets including an airfoil comprising a nominal profile substantially in accordance with Cartesian coordinate values of X, Y and Z and arc coordinate R set forth in Tables 1-19 wherein the X, Y, Z and R distances are in inches, the X and Y coordinate values being smoothly joined by an arc of radius R defining airfoil profile sections at each distance Z, the profile sections at the Z distances being joined smoothly with one another to form a complete airfoil shape.

15. The turbine according to claim 14, wherein said airfoil shape lies in an envelope within about +/−0.25 inches in a direction normal to any airfoil surface location.

16. The turbine according to claim 14, wherein the nominal profile for the airfoil applies in a cold, non-operating condition.

17. The turbine according to claim 14, wherein the nominal profile for the airfoil comprises an uncoated nominal profile.

18. The turbine according to claim 14, wherein the turbine wheel comprises a last stage of the turbine.

19. A turbine according to claim 14, wherein the turbine wheel has about 49 buckets.

20. A turbine according to claim 19 further comprising:

a bucket having a part-span shroud, said part-span shroud located at a distance of about 45% to about 65% of a total airfoil length from a base of said airfoil.

* * * * *